United States Patent [19]

Lockwood

[11] Patent Number: 4,783,004

[45] Date of Patent: Nov. 8, 1988

[54] BALL DRIVE SPRINKLER

[75] Inventor: James F. Lockwood, Lenexa, Kans.

[73] Assignee: Imperial Underground Sprinkler Co., Lenexa, Kans.

[21] Appl. No.: 85,529

[22] Filed: Aug. 14, 1987

Related U.S. Application Data

[63] Continuation of Ser. No. 730,174, May 3, 1985, Pat. No. 4,687,139.

[51] Int. Cl.[4] ..... B05B 15/10

[52] U.S. Cl. ..... 239/205; 239/206; 239/240

[58] Field of Search ..... 239/203, 204, 205, 206, 239/230, 237, 240, 241, DIG. 1

[56] References Cited

U.S. PATENT DOCUMENTS

| | | | |
|---|---|---|---|
| Re. 25,942 | 12/1965 | Reynolds . | |
| 2,955,764 | 10/1960 | Hruby, Jr. | 239/204 |
| 2,990,120 | 6/1961 | Reynolds | 239/204 |
| 3,127,110 | 3/1964 | Reynolds . | |
| 3,131,867 | 5/1964 | Miller et al. . | |
| 3,263,930 | 8/1966 | Friedmann et al. | 239/206 |
| 3,266,730 | 8/1966 | Martini . | |
| 3,334,817 | 8/1967 | Miller et al. . | |
| 3,383,047 | 5/1968 | Hauser . | |
| 3,526,363 | 9/1970 | Hauser . | |
| 3,602,431 | 8/1971 | Lockwood . | |
| 3,627,205 | 12/1971 | Healy . | |
| 3,666,181 | 5/1972 | Healy . | |
| 3,702,173 | 11/1972 | Reynolds . | |
| 3,715,078 | 2/1973 | Reynolds . | |
| 3,771,723 | 11/1973 | Ray . | |
| 3,874,588 | 4/1975 | Flynn | 239/206 |
| 3,930,618 | 1/1976 | Lockwood . | |
| 3,948,285 | 4/1976 | Flynn . | |
| 4,023,595 | 5/1977 | Zakay . | |
| 4,026,471 | 5/1977 | Hunter . | |
| 4,417,691 | 11/1983 | Lockwood . | |

*Primary Examiner*—Douglas C. Butler
*Assistant Examiner*—Michael J. Forman
*Attorney, Agent, or Firm*—Litman, McMahon & Brown

[57] ABSTRACT

A rotary, pop-up sprinkler is provided which includes an in-ground container. A motor is reciprocably mounted in the container and includes a stator, a plate assembly mounted on the stator and a rotor rotatably received in the stator. The rotor includes a turret with a nozzle orifice. Hydraulic pressures on the rotor are balanced whereby anti-rotational drag is substantially reduced. A speed regulator is provided for maintaining a relatively constant rotational speed when the sprinkler is subjected to variances in hydraulic pressure.

20 Claims, 6 Drawing Sheets

Fig. 1.
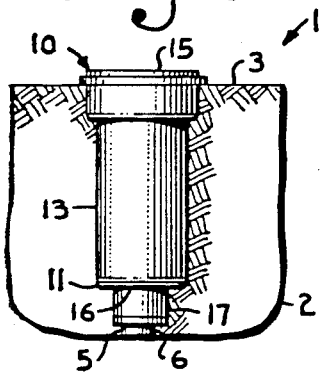
Fig. 2.
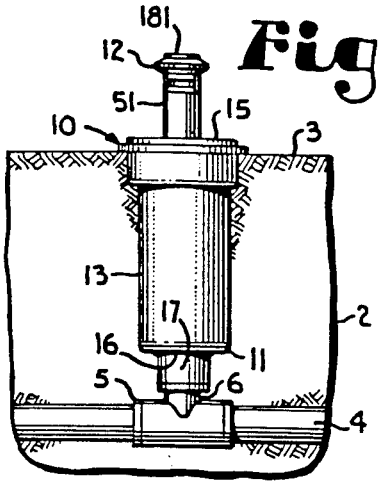
Fig. 4.
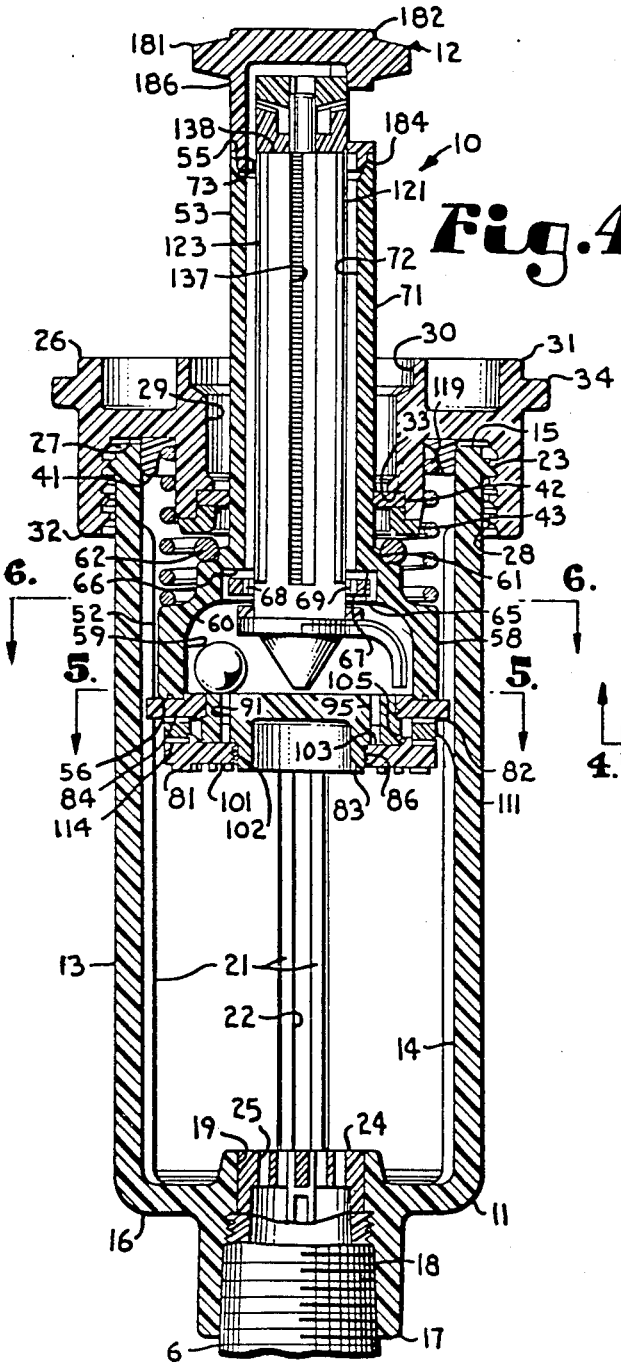
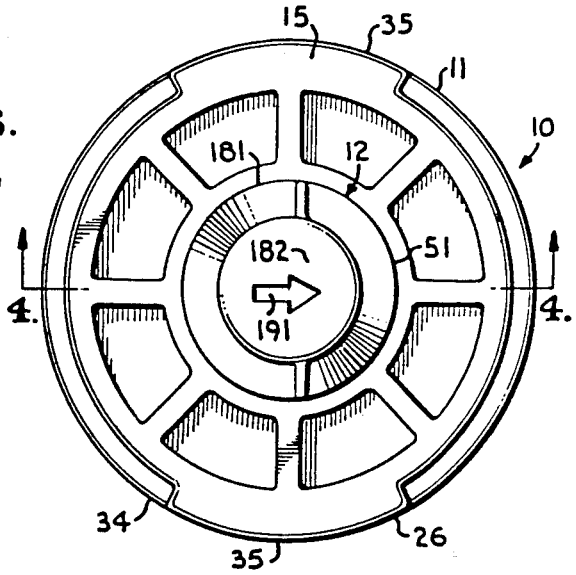
Fig. 3.

Fig. 23.
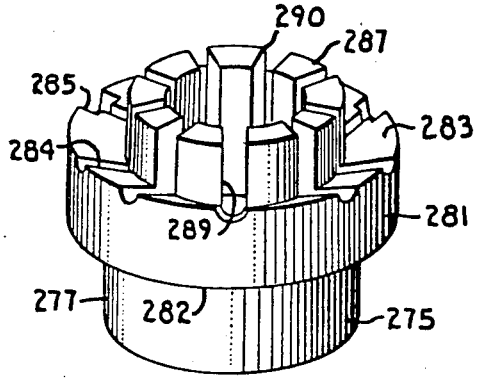
Fig. 24.
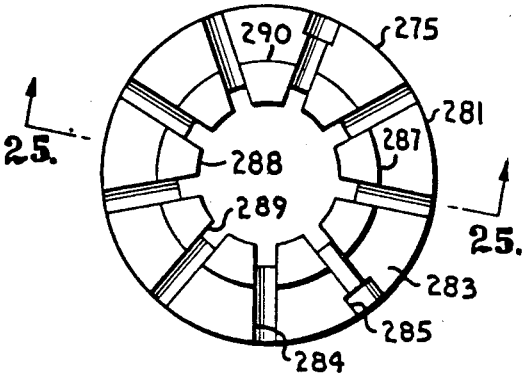
Fig. 25.
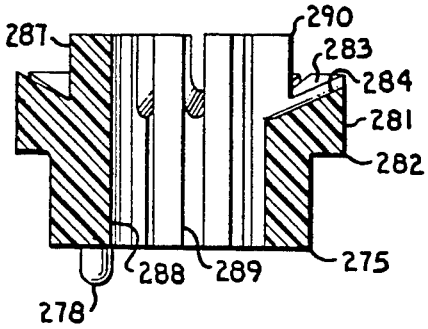
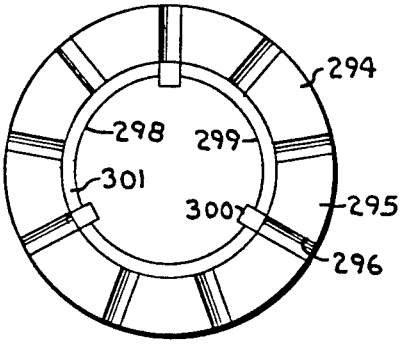
Fig. 26.
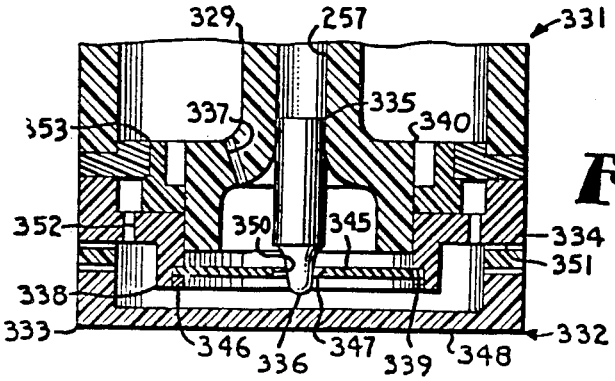
Fig. 27.

BALL DRIVE SPRINKLER

CROSS-REFERENCED TO RELATED APPLICATION

This application is a continuation of Ser. No. 730,174, filed May 3, 1985, now U.S. Pat. No. 4,687,139, issued Aug. 18, 1987.

BACKGROUND OF THE INVENTION

1. Field of the Invention.

This invention relates generally to sprinklers and in particular to a rotary, pop-up sprinkler with a ball drive and a speed regulator.

2. Description of the Prior Art

Sprinklers are used to irrigate vegetation in areas where natural precipitation is insufficient in amount or frequency. For example, grass-covered lawns, golf courses, parks and the like are frequently provided with sprinkler systems. Although above-ground sprinkler systems have a relatively low initial cost, they are usually set up and taken down for each use whereby their operation is relatively labor-intensive. Above-ground systems are subject to loss and damage from a variety of hazards and may contribute to personal injury and property damage if left out between uses.

In order to overcome the disadvantages of above-ground sprinkler systems, underground sprinkler systems have been devised which generally include a piping network buried in shallow trenches and a plurality of sprinkler heads located at predetermined locations to provide the coverage desired. Pop-up sprinklers which extend to use positions when subjected to water pressure and retract to storage positions are preferred because they avoid interference with maintenance equipment and permit the use of the irrigated area.

Spray-type sprinklers generally include a nozzle orifice for dispensing water in a desired pattern comprising a circle or a segment thereof. Such sprinklers tend to have relatively few, if any, moving parts and are thus relatively inexpensive, but their spray patterns are more susceptible to wind deflection and they consume relatively large amounts of water per unit of irrigated area.

Rotary sprinklers, on the other hand, emit a stream or streams of water from one or more nozzle orifices which are rotated to achieve uniform coverage. Rotary sprinklers include motors which are generally driven by water pressure. For example, the Hunter U.S. Pat. No. 4,026,471 discloses a pop-up rotary sprinkler wherein the nozzle is driven by an impeller with a plurality of vanes.

Another type of rotary sprinkler motor is shown in the Reynolds U.S. Pat. Re 25,942 and includes a ball for impacting a projection whereby the nozzle is incrementally advanced. The ball in such a sprinkler is driven in a circular pattern by a swirling vortex of water within the sprinkler body.

However, a problem with many prior art rotary sprinklers is that their motors tend to be relatively inefficient and thus require substantial water pressure for their operation, which reduces the overall throughput of the system. In particular, the bearing surfaces provided in most rotary sprinklers generate substantial amounts of friction and anti-rotational drag. A relatively large source of drag in many rotary sprinklers is a thrust bearing arrangement common thereto. The rotating element of most prior art sprinklers is extended by water pressure into engagement with a flange or ring which limits further extension and provides a thrust bearing surface. However, the water pressure tends to force the rotary nozzle element against the stop ring whereby frictional losses are encountered.

Yet another problem with many prior art rotary sprinklers relates to the introduction of foreign substances such as debris, sand and dirt into their bearing surfaces, which increases frictional drag and can eventually clog or damage a sprinkler. To overcome such problems rotary sprinklers generally include either sealed bearings or a flushing arrangement such as that shown in the Miller et al. U.S. Pat. No. 3,334,817.

Heretofore there has not been available a rotary, pop-up sprinkler with the advantages and features of the present invention.

SUMMARY OF THE INVENTION

In the practice of the present invention, a rotary, pop-up sprinkler is provided which includes an in-ground container. An hydraulic motor is reciprocably mounted in the container and includes a stator having a stator bore, a plate assembly mounted on the stator and a rotor rotatably received in the stator bore. The rotor includes a turret assembly with a nozzle orifice. A raceway is formed in the stator and receives a ball adapted to revolve under hydraulic pressure and intermittently strike an impact lever on the rotor whereby the latter is rotated. A speed regulator may be provided on the plate assembly for maintaining a relatively constant rotational speed in response to varying hydraulic pressures.

OBJECTS OF THE INVENTION

The principal objects of the present invention are: to provide a rotary, pop-up sprinkler; to provide such a sprinkler which includes an hydraulic motor with a balltype drive; to provide such a sprinkler wherein hydrodynamic forces are balanced to minimize anti-rotational drag; to provide such a sprinkler which does not employ a thrust bearing in its motor; to provide such a sprinkler which can distribute water over a predetermined area which may comprise a circle, any desired segment thereof or some other configuration; to provide such a sprinkler which can be provided, without limitation, in half circle, quarter circle, full circle and other versions; to provide such a sprinkler with a speed regulator adapted for maintaining a relatively constant rotational speed in response to various hydraulic pressures; to provide such a sprinkler with a filtering system designed to minimize the need for cleaning; and to provide such a sprinkler which is efficient in operation, economical to manufacture, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a vertical cross-section of a sprinkler system with a sprinkler embodying the present invention imbedded in the ground in its retracted position.

FIG. 2 is a vertical cross-section of the sprinkler system with the sprinkler in its extended position.

FIG. 3 is a top plan of the sprinkler.

FIG. 4 is a vertical cross-section of the sprinkler taken generally along line 4—4 in FIG. 3.

FIG. 23 is a perspective of a lower half of a turret of the full circle sprinkler.

FIG. 24 is a top plan of the turret lower half of the full circle sprinkler.

FIG. 25 is a vertical cross-section of the turret lower half of the full circle sprinkler.

FIG. 26 is a bottom plan of a turret upper half of the full circle sprinkler.

FIG. 27 is a vertical cross-section of a full circle sprinkler with a speed regulator comprising a fourth alternative embodiment of the present invention.

DETAILED DESCRIPTION OF THE PREFERRED EMBODIMENTS

Figure 5:
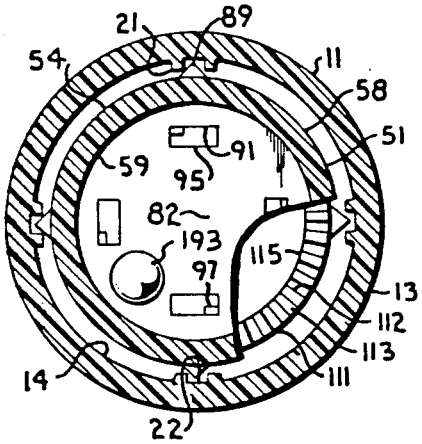
FIG. 5 is a horizontal cross-section of the sprinkler taken generally along line 5—5 in FIG. 4.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The terms "upper", "lower" and derivatives thereof refer to the invention as oriented in FIGS. 4, 17, 22 and 27. The terms "inwardly", "outwardly" and derivatives thereof mean radially with respect to the axes of rotation of the sprinklers comprising the present invention.

Referring to the drawings in more detail, the reference numeral 1 generally designates a sprinkler system with a half circle sprinkler 10 embodying the present invention. The sprinkler system 1 is of the underground type and is substantially imbedded within earth 2 below a ground surface 3 thereof. The sprinkler system 1 comprises a network of conduits 4 with sprinklers 10 connected thereto by T-fittings 5. Each T-fitting 5 includes a male-threaded middle leg 6.

The sprinkler 10 generally comprises a container 11 with a motor 12 extensibly mounted therein. The container 11 comprises a cylindrical side wall 13 enclosing a bore 14. The container 11 includes upper and lower ends 15, 16. A coupling 17 is located at the container lower end 16 and includes a female-threaded bore 18 communicating with the container bore 14. Positioned above the coupling bore 18 in communication with the container bore 11 is a coaxial, female-threaded screen receiver 19 adapted to threadably receive a male-threaded screen 24 with a plurality of orifices 25 extending therethrough.

Figure 6:
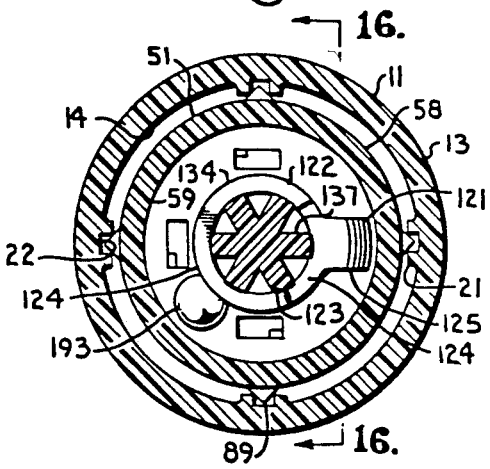
FIG. 6 is a horizontal cross-section of the sprinkler taken generally along line 6—6 in FIG. 4.
Figure 7:
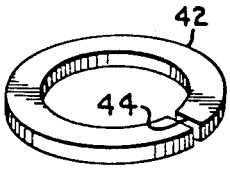
FIG. 7 is a perspective of a wiper ring of the sprinkler.

Four closely spaced pairs of container guide ribs 21 extend longitudinally along the inside of the side wall 13 within the bore 18. As shown in FIGS. 5 and 6, the guide rib pairs 21 are radially spaced at 90 degree intervals to each other and form longitudinally extending container guide channels 22 therebetween. Male threading 23 extends around the container upper end 15 on the outside of the side wall 13.

A cover 26 includes a coaxial, downwardly open groove 27 with female threading 28 adapted to threadably receive the container male threading 23. A cover bore 29 extends coaxially through the cover 26 and includes a cover counterbore 30 open at an upper end 31 of the cover 26. At a cover lower end 32 the cover bore 29 is provided with an annular wiper ring shoulder 33. The cover 26 is provided with an outwardly-extending, annular flange 34 with diametrically opposed bosses 35 for receiving the manufacturer's name, etc. (not shown).

A combination seal washer and spring retainer 41 is placed in the cover groove 27 and deforms under compression over the container upper end 15 to create a watertight seal therebetween. A wiper washer 42 with a radial slit 44 is received in the wiper washer shoulder 33 and is held in place by an annular wiper washer retainer 43.

The motor 12 includes a stator 51 with a base 52 and a column 53 terminating in lower and upper ends 54, 55 respectively. The stator lower end 54 includes a coaxial, flat lower edge 56 with a downwardly-open groove 57. The base 52 includes a coaxial sidewall 58 and a coaxial, annular O-ring shoulder 61 adapted to receive an elastomeric O-ring 62 which engages the wiper washer retainer 43 when the motor 12 is in its extended position. A helical motor return spring 119 is received in the upper part of the container bore 14 and engages the container seal 41 and a return spring shoulder 120 on the stator base 52.

Figure 14:
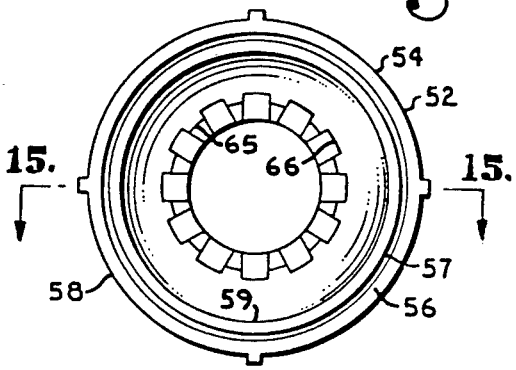
FIG. 14 is a bottom plan of a stator of the sprinkler.
Figure 15:
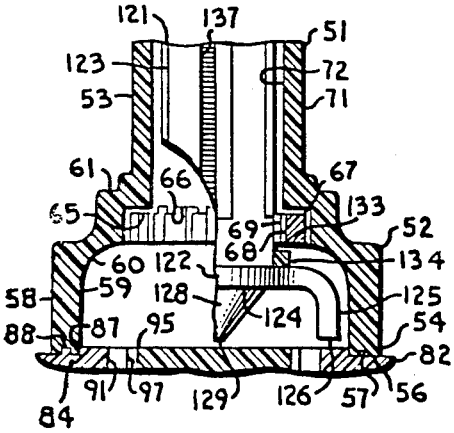
FIG. 15 is a vertical cross-section of the sprinkler particularly showing a rotor and the stator and taken generally along line 15—15 in FIG. 14.

The base 52 is hollow and forms a coaxial raceway 59 with radiused corners 60. As shown in FIGS. 14 and 15, a coaxial, annular stabilizer ring shoulder 65 is provided adjacent to the column 53. A plurality of stabilizer ring shoulder notches 66 are located at radially spaced intervals and extend outwardly and upwardly from the stabilizer ring shoulder 65.

The column 53 includes a coaxial, tubular side wall 71 forming a coaxial, cylindrical column bore 72. The column bore 72 terminates at an upwardly-open column counterbore 73 at the column upper end 55. A stablizer ring 67 is secured by suitable means in the stabilizer shoulder 65 and includes four cutouts 68 at 90 degree radial intervals extending outwardly from an inner edge 69 thereof.

A plate assembly 81 encloses the raceway 59 and includes a bottom plate 82 with a coaxial, cylindrical, downwardly-projecting hub 83 and a bottom plate flange 84 projecting radially outwardly therefrom. The hub 83 includes a downwardly-open blind opening 85 and a circumferential male threaded portion 86. The flange 84 includes a coaxial shoulder 87 with an upwardly-extending annular projection 88. As shown in FIG. 15, the shoulder 87 receives the stator lower edge 56 with the projection 88 inserted into the stator base groove 57. Guide tabs 89 extend outwardly from the flange 84 and are slidably received in respective guide channels 22.

Figure 8:
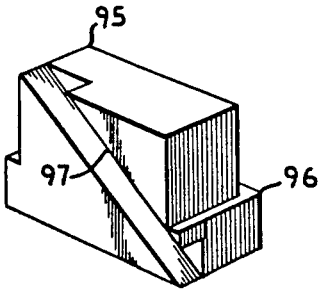
FIG. 8 is a perspective of a swirl jet of the sprinkler.

Four swirl jet receivers 91 extend through the flange 84 at 90 degree radial intervals adjacent to the hub 83. A swirl jet 95 as shown in FIG. 8 is plated in each swirl jet receiver 91. Each swirl jet 95 has a six-sided rectilinear configuration with a flange 96 extending outwardly from three sides thereof. A diagonal passage 97 extends between opposite corners of a fourth side of each swirl jet 95. The swirl jet passages 97 are sized so that their combined cross-sectional area corresponds to the outlet area of the sprinkler 1, as will be explained more fully hereinafter. The swirl jets 95 are positioned in the swirl jet receivers 91 with their flanges 96 engaging the bottom of the bottom plate flange 84. The swirl jet passages 97 thus extend through the bottom plate 82 at tangential angles to the rotational axis of the motor 12.

A plate retainer 101 includes a coaxial, female-threaded opening 102 which extends between upper and lower surfaces 103, 104 and is threadably received on the male-threaded portion 86 of the bottom plate hub 83. Four plate retainer upper tabs 105 extend upwardly from the plate retainer upper surface 103 and are radially spaced at 90 degree intervals.

A coaxial filter ring 111 is clamped against the underside of the bottom plate flange 84 by the plate retainer 101 and includes a plurality of radially extending slots 112 on upper and lower faces 113, 114 thereof. As shown in FIG. 4, the filter ring 111 engages and is held in place by the plate retainer upper tabs 105 in spaced relation outwardly from the swirl jet flanges 96. An annular plate assembly water passage 115 is thus formed between the filter ring 111 and the swirl jets 95 an communicates with the container bore 14 through the slots 112.

A rotor 121 is rotatably mounted within the stator 51 and includes a base 122 and a column 123. The base 122 includes a base disc 124 with an impact lever 125 extending therefrom. As shown in FIG. 4, the impact lever 125 extends radially outwardly from the disc 124 and curves downwardly to a lower end 126. A beveled leading edge 127 extends along the circumference of the disc 124 for slightly less than a quarter (90 degrees) thereof, along one side of the impact lever 125 and across the impact lever lower end 126. A coaxial, truncated cone 128 extends downwardly from the rotor disc 124 and terminates at a flat end 129. A ball 193 is placed within the raceway 59 and has a diameter such that it will pass between the rotor cone 128, the impact lever 125 and the bottom plate 82.

The rotor column 123 includes a lower journal portion 133 journalled in the stabilizer ring 67. A rotor bumper washer 134 is placed over the journal portion 133 in engagement with the rotor disc 124. As shown in FIG. 6, the rotor shaft 123 is substantially cylindrical with six longitudinally extending grooves 137 each having a V-shaped cross-sectional configuration and extending from the journal portion 123 to an upper end 138 of the shaft 123. The grooves 137 facilitate molding the rotor column 123 and are unrelated to its operation. A turret pin 139 extends coaxially upwardly from the rotor shaft upper end 138 and includes a spline 140 extending outwardly therefrom.

Figure 9:
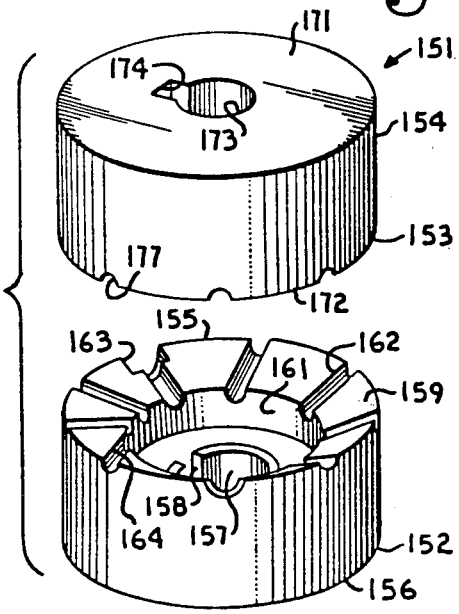
FIG. 9 is an exploded perspective of a turret assembly of the sprinkler.
Figure 10:
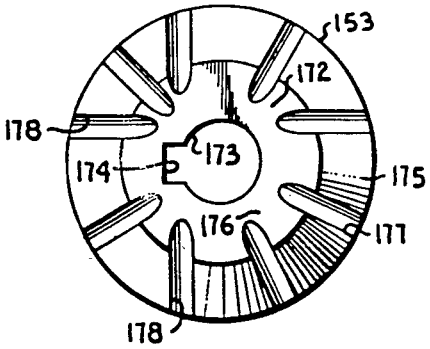
FIG. 10 is a bottom plan of an upper turret half of the sprinkler.
Figure 11:
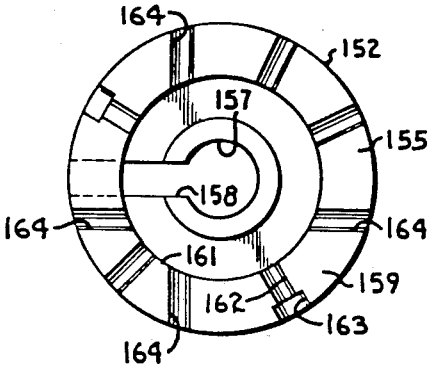
FIG. 11 is a top plan of a lower turret half of the sprinkler.

A turret assembly 151 is mounted on the rotor shaft upper end 158 and comprises lower and upper halves 152, 153. The turret lower half 152 has a substantially cylindrical configuration with an outer surface 154, upper and lower ends 155, 156 and a coaxial bore 157. A keyway 158 extends radially outwardly from the bore 157 parallel to the rotational axis of the rotor 121. As shown in FIG. 9, the turret lower half upper end 155 includes a downwardly concave, beveled mating surface 159. An annular, coaxial turret passageway 161 communicates with the lower turret half bore 157 and opens upwardly at the mating surface 159.

Lower, radial nozzle grooves 162 extend radially outwardly from the rotational axis of the rotor 121 along the mating surface 159 between the outer surface 154 and the passageway 161. Two of the lower radial nozzle grooves 162 include counterbores 163 adjacent to the outer surface 154. Four lower tangential nozzle grooves 164 extend along the mating surface 159 tangentially to the bore 157.

Figure 12:
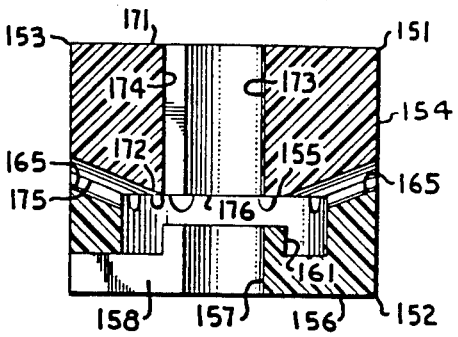
FIG. 12 is a vertical cross-section of the turret assembly.
Figure 13:
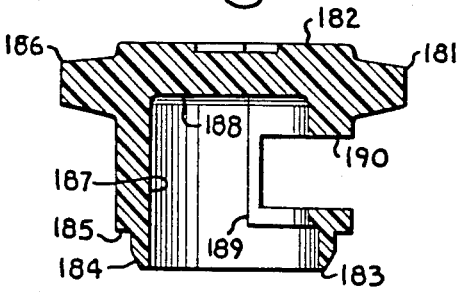
FIG. 13 is a vertical cross-section of an arc shield of the sprinkler.

The upper half turret 153 includes upper and lower ends 171, 172 and a coaxial bore 173 extending therebetween. An upper turret half keyway 174 extends radially outwardly from the bore 173 in spaced, parallel relation from the rotational axis of the rotor 121. As shown in FIG. 12, the upper turret half upper end 171 is substantially flat and the lower end 172 includes a beveled mating surface 175 corresponding to the configuration of the lower turret half mating surface 159. The lower end 172 also includes a flat portion 176 adapted to enclose the turret passageway 161 with the turret halves 152, 153 connected. The lower end 172 thus has a downwardly-extending, frusto-conical configuration. The upper turret half lower end 172 includes a plurality of radial and tangential upper nozzle grooves 177, 178 corresponding to the lower nozzle grooves 162, 164.

The turret assembly halves 152, 153 are placed on the rotor 121 with their bores 157, 173 and keyways 158, 174 aligned and receiving the turret pin 139 and the spline 140 respectively. With the turret halves 152, 153 thus mounted, the upper nozzle grooves 177, 178 enclose respective lower nozzle grooves 162, 164 between the turret assembly outer surface 154 and the passageway 161 and form nozzle orifices 165.

An arc shield 181 is mounted on the stator upper end 55 and includes upper and lower ends 182, 183. The shield lower end 183 includes a coaxial, annular, downwardly-depending flange 184. The flange 184 is received within the column counterbore 73 in an interference fit therewith, for example, by ultrasonic welding, and includes a shoulder 185 which registers with the stator column upper end 55. The arc shield 181 includes a coaxial, substantially tubular body 186 with a coaxial shield bore 187 terminating in a blind end 188 below the shield upper end 182.

A radial turret bearing surface 189 is integrally formed with the arc shield 181 and extends inwardly from the bore 187 thereof. The turret bearing surface 189 extends slightly less than halfway around the bore 187 and includes an arcuate shield slot 190 which likewise extends slightly less than halfway around the shield body 186. The shield upper end 182 may include indicia such as an arrow 191 indicating the exit direction of water from the arc shield 181.

The sprinkler 10 is normally in its retracted position as shown in FIG. 1 with the motor 12 thereof substantially enclosed within the container 11 and thus protected from various above-ground hazards such as mowing equipment, golf carts, pedestrians and the like.

When water pressure is communicated to the sprinkler 10 through the conduit 4, the motor 12 is urged upwardly as the container bore 14 fills. The container screen 24 screens debris particles from the conduit 4 which are too large to pass through the screen orifices 25. As the motor 12 rises, the stator column 53 extends upwardly from the level of the cover 26. At the upper limit of extension of the motor 12, the O-ring 62 engages the wiper washer retainer 43 and forms a substantially water-tight seal therewith.

Water enters the motor 12 through the radial slots 112 in the filter ring 111, which are smaller yet than the screen orifices 25. The pressurized water is then emitted into the raceway 59 through the swirl jet passages 97.

The filter ring slots 112 have smaller cross-sectional areas than the nozzle grooves 165 but because the former are so much more numerous, the combined cross-sectional area of the filter ring slots 112 is much greater than that of the nozzle orifices 165. Therefore, particles small enough to pass through the filter ring slots 112 will easily pass through the nozzle orifices 165. A substantial number of filter ring slots 112 could become clogged without affecting the water flow to the nozzle orifices 165 whereby the sprinkler 10 will operate at substantially peak condition for relatively long periods of time between cleanings. The bearing surfaces of the sprinkler 10 are designed to eliminate or at least minimize the possibility of debris becoming trapped thereon.

The water enters the raceway 59 through the swirl jet passages 97 and forms a swirling vortex therein which sweeps the ball 193 around the raceway 59. On each revolution through the raceway 59 the ball 193 strikes the impact lever 125 whereby the rotor 121 is rotated incrementally about its rotational axis. The ball 193 strikes the impact lever 125 at its beveled edge 127 and is thus deflected slightly from its path of revolution as it skips over the impact lever 125. The incremental rotations of the rotor 121 are relatively small for each strike of the ball 193, but the ball revolves at a relatively high frequency, e.g. approximately 1 to 3 revolutions per second. Thus, the rotational movements of the rotor 121 appear to be relatively continuous and smooth. Furthermore, the relatively small incremental rotational movements of the rotor 121 tend to prevent dry spots and over-saturation in the ground being irrigated whereby a relatively uniform coverage of water is achieved.

From the raceway 59 the water flows through the stabilizer ring shoulder notches 66 and the stabilizer ring cutouts 68 and into the stator column bore 72.

The sprinkler 10 of the present invention is estimated to operate with approximately 6% of the friction of comparable thrust bearing sprinkler and is designed to utilize hydrodynamic pressure within the column bore 72 to enhance its efficiency of operation in several respects. First of all, the rotor base 122 is balanced within the raceway 59 by hydrodynamic pressure so that frictional, sliding engagement between the various parts is kept to an absolute minimum. In particular, the hydrodynamic pressure within the stator column bore 72 exerts a downward force against the bumper washer 134 which counterbalances the upward, lifting force on the rotor 121 exerted by hydrodynamic pressure within the raceway 59. Thus, in normal operation, the bumper washer 134 is maintained in spaced relation from the stabilizer ring 67 by hydrodynamic pressure. In fact, engagement between the bumper washer 134 and the stabilizer ring 67 is likely to occur only during start-up, i.e. when water surges into the raceway 59 from the container 11 with the stator column bore 72 full of air, and when an occasional air bubble is received in the sprinkler 1.

Thus, the rotor 121 in operation is designed to rotate substantially freely suspended by hydrodynamic pressure within the stator 51. In particular, the sprinkler 10 is designed to utilize hydrodynamic forces within the stator 51 to avoid the necessity of a thrust bearing. The hydrodynamic pressure within the space between the arc shield bore blind end 188 and the turret assembly upper end 155 exerts a downward force on the rotor 121 so that the latter is subjected to substantially balanced, hydrodynamic pressures, the upward and downward components of which are substantially equal and thus cancel each other out. A balanced or equilibrium condition is thus created whereby the rotor 121 "floats" in a relatively friction-free environment within the stator 51.

Secondly, hydrodynamic pressure within the space between the arc shield bore blind end 188 and the turret assembly upper end 155 tends to reduce the upward pressure on the rotor 121. Because the areas of the rotor 121 subjected to upward-acting and downward-acting hydrodynamic pressure are nearly equal, a balanced or equilibrium condition is created so that the rotor 121 "floats" in a relatively friction-free environment within the stator 51.

The hydrodynamic pressure within the arc shield 181 tends to force the turret assembly outer surface 154 against the arc shield radial turret bearing 189. A substantially watertight seal is thus created between the turret assembly outer surface 154 and the arc shield turret bearing 189 to prevent any substantial water leakage therebetween. Since a general condition of equilibrium is maintained with respect to the rotor 121, substantially the only friction encountered thereby is between the arc shield 181 and the turret assembly 151.

Water enters the turret assembly 151 through the nozzle orifices 165 exposed within the arc shield bore 187 and is communicated to the turret passageway 161. From the turret passageway 161 the water is expelled from the sprinkler 10 through the orifices 165 which are exposed through the shield slot 190. Water is emitted from the exposed nozzle orifices 165 in relatively continuous streams which are rotated relatively smoothly to provide maximum beneficial irrigation. The combined cross-sectional areas of the swirl jet passages 97 and the nozzle orifices 165 preferably correspond so that a relatively constant velocity is maintained in the vortex created by the swirl jets 95 in the raceway 59 whereby the ball 193 rotates at a relatively constant speed therein. The swirl jet passages of other sprinklers embodying the present invention, including the quarter circle and full circle sprinklers described hereinafter, are also preferably sized according to the combined cross-sectional areas of their respective orifices. For example, since the quarter circle sprinkler has less nozzle orifice area, the combined swirl jet passage area is less, and a greater combined swirl jet area is provided with the full circle sprinkler.

The counterbores 163 associated with some of the nozzle orifices 165 function to dissipate the water streams emitting therefrom so that more water falls in the area near the sprinkler 10. Thus, by providing counterbores 163 where needed, the dispersal pattern from the sprinkler 10 can be altered to effect substantially uniform coverage over a circular area bounded by its maximum range. It is anticipated that one or more of the nozzle orifices 165 might be otherwise modified to achieve desired dispersal characteristics.

Figure 17:
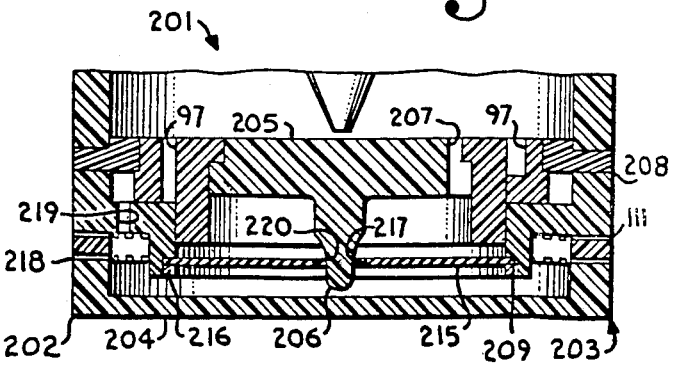
FIG. 17 is a vertical cross-section of a sprinkler comprising a first alternative embodiment of the present invention with a speed regulator.
Figure 18:
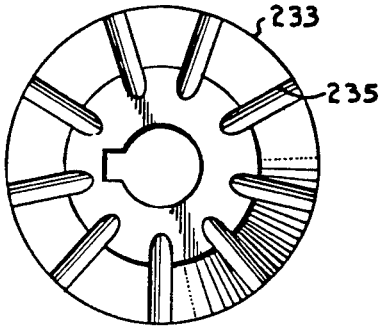
FIG. 18 is a bottom plan of a top turret half for a quarter circle sprinkler comprising a second alternative embodiment of the present invention.
Figure 19:
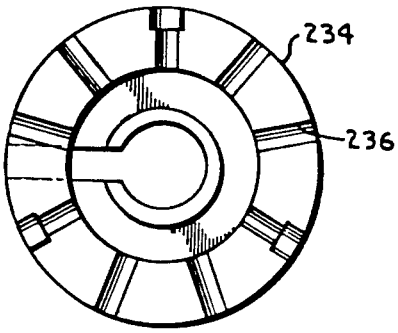
FIG. 19 is a top plan of a lower turret half of the quarter circle sprinkler.
Figure 20:
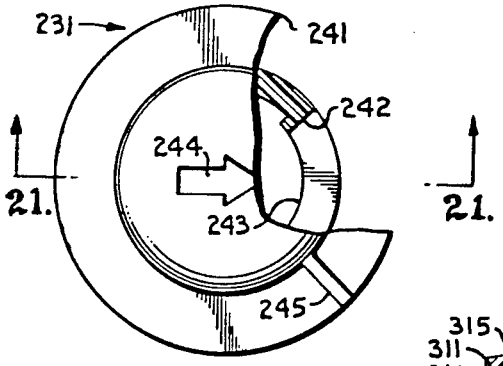
FIG. 20 is a top plan of a cover of the quarter circle sprinkler with portions broken away to reveal the turret assembly thereof.

A sprinkler 201 comprising a first modified embodiment of the present invention is shown in FIG. 17 and includes a speed regulator 202 incorporated in a plate assembly 203. The plate assembly 203 includes a bottom plate 204 mounted on the lower edge 56 of the stator 51. The bottom plate 204 receives a valve spool 205 with a lower end portion 206 having a tapered configuration with a downardly-diminishing thickness. The valve spool 205 includes anti-swirl or bypass jet orifices 207 which extend therethrough and are slanted in directions opposite to the slant of the swirl jet passages 97.

An adapter plate 208 is placed on the bottom plate 204 and includes an annular diaphragm shoulder 209. A circular diaphragm 215 comprising an elastomeric material is retained against the bottom of the adapter plate 208 by a diaphragm retainer 216 which is received in the diaphragm shoulder 209. The diaphragm includes a centered diaphragm opening 217 which receives the tapered valve spool end portion 206 extending coaxially therethrough. The diaphragm opening 217 has a slightly larger diameter than the valve spool end portion 206 so that water is admitted through a clearance area 220 therebetween.

The filter ring 111 is placed against the adapter plate 208 and is held in place by an end cap 218. The adapter plate 208 includes a plurality of radially spaced adapter plate orifices 219 located inside of and above the filter ring 111.

In operation, the speed regulator 202 functions to maintain a constant rotational speed of the rotor 121 even though the hydrodynamic pressure in the conduit 4 may vary. Water is admitted through the filter ring 111 and a portion of the stream flows through the adapter plate orifices 219 to the swirl jets 95 in the normal fashion. Another portion of the water stream flows through the diaphragm opening 217 to the anti-swirl orifices 207 and counteracts the swirling vortex emitted by the swirl jets 95.

The diaphragm 215 deforms upwardly when subjected to water pressure. As the diaphragm 215 deforms upwardly, its opening 217 expands. Thus, the greater the hydrodynamic pressure, the more the diaphragm opening 217 expands and the larger the effective clearance area 220 becomes.

As the clearance area 220 increases, more water flow is available to the anti-swirl orifice 207 whereby more resistance is offered to the swirling vortex from the swirl jets 95. Thus, the diaphragm 215 balances the volume and pressure of the bypass water flow to the anti-swirl orifices 207. For example, when the hydrodynamic pressure is relatively great the effective clearance area 220 is relatively large so that a relatively large amount of high-pressure water is emitted from the anti-swirl jets 207 to counteract a greater flow through the swirl jets 95. At low hydrodynamic pressure the converse is true.

Figure 28:
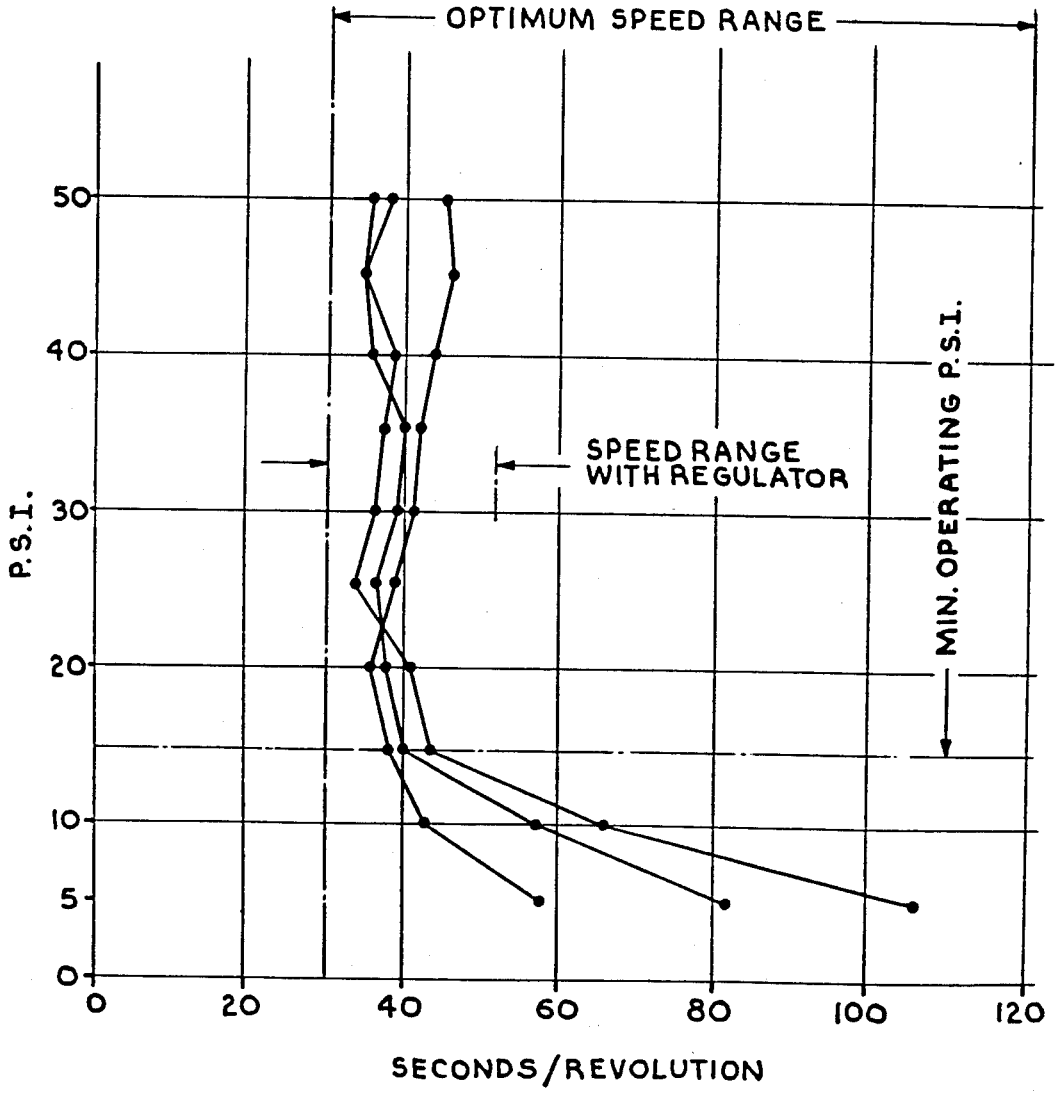
FIG. 28 is a graph showing the rotational speed of several sprinklers according to the present invention with speed regulators at various hydraulic pressures.

It has been determined that by balancing the force of the streams from the swirl jets 95 and the anti-swirl jets 207, the sprinkler 201 will operate at a relatively constant rotational speed over a wide range of operating hydrodynamic pressures. FIG. 28 shows the performance of several sprinklers with speed regulators according to the present invention.

A quarter circle sprinkler 231 comprising a second modified embodiment of the present invention is shown in FIGS. 18-21. The quarter circle sprinkler 231 includes a modified turret assembly 232 with upper and lower turret halves 233, 234 having radially extending nozzle grooves 235, 236 respectively. A total of 9 grooves 235, 236 are provided on each turret half 233, 234 respectively and are radially spaced at 40 degree intervals.

The quarter circle sprinkler 231 includes a modified arc shield 241 with a shield slot 190 which extends through an arc of approximately 90 degrees, or a quarter of the circumference of the arc shield 241. The shield slot 242 extends through a turret bearing 243 which projects inwardly into the arc shield 241. The turret bearing 243 extends through an arc of slightly greater than 90 degrees with respect to the rotational axis of the turret halves 233, 234. An arrow 244 is formed in the top of the arc shield 241 to designate the direction of water disperal and range marks 245 extend radially outwardly along the top of the arc shield 241 to designate the area of coverage of the quarter circle sprinkler 231. The quarter circle sprinkler 231 is adapted to receive a speed regulator 202 similar to that provided with the half circle sprinker 10.

A full circle sprinkler 251 comprising a third modified embodiment of the present invention is shown in FIGS. 22–26 and includes a modified stator 252 and rotor 253. The full circle stator 252 includes a plate assembly 254 which is substantially identical to the plate assembly 81 of the half circle sprinkler 10 except that an inner stator column 255 extends upwardly from a base plate 256 and includes a coaxial bore 257. The stator 252 includes a counterbore 263 at its upper end 262. The inner stator column 255 terminates at an upper end 258 in spaced relation below a column upper end 262 of the stator 261.

The rotor 253 includes a base 264 with an impact lever 265 extending radially outwardly and downwardly therefrom and a rotor column 266 having a coaxial bore 267 and an upper end 268. The rotor column upper end 268 includes a counterbore 269 with an annular turret stop shoulder 270 immediately thereunder. An alignment slot 271 is formed in the rotor column upper end 268 and extends through the counterbore 269 and the turret stop shoulder 270.

The full circle sprinkler 251 includes a turret assembly 274 comprising lower and upper halves 275, 276. The turret lower half 275 includes a lower portion 277 which is adapted to be received within the rotor column counterbore 269 in a fitting engagement therewith. A turret alignment pin 278 depends downwardly from the lower portion 277 and is received in the alignment slot 271 with the turret lower half lower portion 277 in registry with the turret stop shoulder 270.

The turret lower half 275 includes a coaxial intermediate portion 281 with a relatively sharp, lower peripheral edge 282 and an annular mating surface 283 with a beveled configuration canted downwardly and inwardly. A plurality (e.g. 9) of lower nozzle grooves 284 extend radially outwardly along the mating surface 283. As shown in FIG. 24, three of the lower nozzle grooves 284 include counterbores 285. The turret lower half 275 includes a coaxial upper portion 281. The turret lower half 275 includes a coaxial upper portion 287 extending upwardly from the intermediate portion 281. The turret lower half 275 includes a coaxial bore 288 extending therethrough with a plurality of radially-spaced, longitudinally extending slots 289. The slots 289 correspond to the spacing of the nozzle grooves 284 and are aligned in communication therewith. The slots 289 extend completely through the lower half upper portion 287 whereby the latter is subdivided into 9 discrete castellations 290.

The turret upper half 276 includes upper and lower ends 293, 294. The lower end 294 includes a beveled lower mating surface 295 with a plurality of radially extending upper nozzle grooves 296. The upper end 293 forms an upper, peripheral corner 297 which is relatively well-defined and angular.

A coaxial bore 298 extends through the turret upper half 276 between its upper and lower ends 293, 294. A weld bead 299 extends inwardly from the bore 298. A plurality of radially spaced tabs 300 extend radially inwardly from the bore 298 and downwardly from the weld bead 299. The bore 298 includes a flared upper portion 301 open at the upper end 293 of the upper turret half 276.

The turret halves 275, 276 are connected by inserting the lower half upper portion 287 into the upper half bore 298 until the former registers with the stop 299. The tabs 300 are received in the turret lower half slots 289 to align the halves 275, 276 whereby respective lower and upper nozzle grooves 284, 296 are placed one on top of the other to form nozzle orifices 303. The turret assembly 274 is placed on the rotor column 266 with the turret lower half lower portion 277 received in the rotor counterbore 269 and the alignment pin 278 received in the alignment slot 271.

A rotor cap 305 includes a stem 306 adapted to be received in the inner stator column bore 257 through the upper end 258 thereof. A rotor cap head 307 is provided at the upper end of the rotor cap 305 and includes top and bottom sides 308, 309. The head bottom side 309 includes a downwardly-open, annular channel 310 bounded by an annular flange 311. The rotor cap top side 308 includes an indicia 312 designating that the sprinkler 251 is adapted to distribute water in a full circle.

Upper and lower turret flexible shields 315, 316 are provided for enclosing the stator 252. Each turret shield 351 has a thin, circular, washer-like configuration with an outside diameter approximately equal to the outside diameter of the stator 252 and an inside diameter slightly less than the outside diameter of the turret assembly 274.

A coaxial, annular ring 317 is inserted in the stator column counterbore 263 to provide a substantially square edge 318 for the stator column upper end 262. Upper and lower annular shield retainer rings 321, 322 have L-shaped cross-sectional configurations and are adapted for placement over the turret shields 315, 316 respectively whereby the latter are mounted on the rotor cap flange 311 and the stator column upper end edge 318 respectively.

Figure 21:
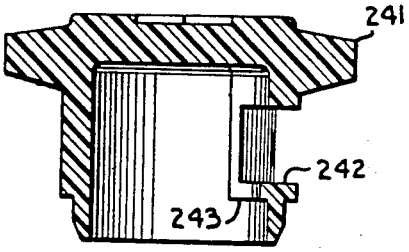
FIG. 21 is a vertical cross-section of the quarter circle sprinkler taken generally along line 21—21 in FIG. 20.
Figure 22:
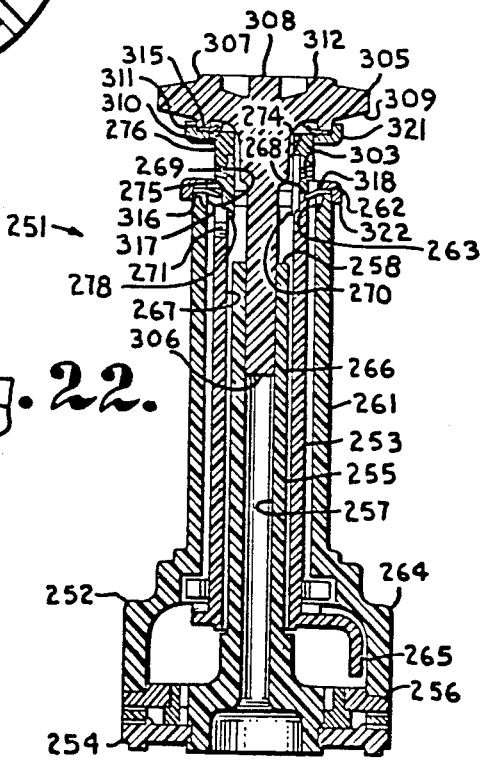
FIG. 22 is a vertical cross-section of a full circle sprinkler comprising a third alternative embodiment of the present invention.
Figure 16:
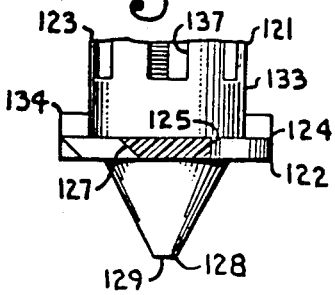
FIG. 16 is a vertical cross-section of the sprinkler taken generally along line 16—16 in FIG. 6.

As shown in FIG. 21, with the turret shields 315, 316 in place they project inwardly and engage the turret peripheral corners 282, 297. The turret peripheral corners 282, 297 are spaced slightly further apart than the upper and lower shields 315, 316 whereby the latter are slightly deformed with the turret assembly 274 in position, as shown in FIG. 22. The turret assembly corners 282, 297 form circular contacts with the shields 315, 316 which are extremely narrow whereby relatively little frictional resistance to rotation is encountered therebetween. Furthermore, anti-rotational friction is minimized because the turret shields 315, 316 are preferably formed of a material with a relatively low coefficient of friction.

In operation the full circle sprinkler 251 functions in a substantially similar manner to the half circle sprinkler 10 and the quarter circle sprinkler 231 except that water is distributed through a full 360 degree circle. Water is admitted to the turret assembly 274 through the alignment slot 271 and the rotor column bore 267. The rotor 253 of the full circle sprinkler 251 is maintained substantially in equilibrium by hydrodynamic pressure within the stator 252 and encounters very little frictional resistance to rotation, particularly in view of the anti-friction bearing arrangement between the turret assembly 274 and the turret shields 315, 316.

A full circle sprinkler 331 comprising a fourth alternative embodiment of the present invention with a speed regulator 332 is shown in FIG. 27. The sprinkler 331 includes a plate assembly 333 with a bottom plate 334. A cylindrical valve spool 335 is inserted partway into the inner stator column bore 257 and includes a lower end portion 336 having a tapered configuration with a downwardly-reducing diameter. Anti-swirl jets or orifices 337 extend through a base 340 of the inner stator column 329.

An adapter plate 338 is mounted on the plate assembly bottom plate 334 and includes a diaphragm shoulder 349. A diaphragm 345 substantially similar to the diaphragm 215 described in connection with the first modified sprinkler 201 is mounted on the adapter plate 338 by an annular diaphragm retainer 346. The diaphragm 345 includes a center opening 347 with a slightly larger diameter than that of the valve spool lower end portion 336 whereby an annular clearance area 350 is formed therebetween. An annular filter ring 351 is mounted on the adapter plate 338 and an end cap 348 is attached thereto whereby the plate assembly 333 is substantially enclosed.

A portion of the flow entering the plate assembly 333 through the filter ring 351 flows through orifices 352 in the adapter plate 338 and then through swirl jets 353. Another portion of the water flow is admitted through the clearance area 350 to the anti-swirl jets 337 for regulating the rotational speed of the sprinkler 331 in the manner described in connection with the first modified sprinkler 201.

The following theoretical frictional analyses apply to a hypothetical prior art sprinkler with a thrust bearing and the half circle, quarter circle and full circle sprinklers 10, 231, 251 respectively of the present invention.

| FRICTIONAL ANALYSIS |
|---|
| f = Coefficient of Friction (hypothetical) = .33 (Applies to all Equations) |
| F = f(N) = Resistance to Motion |
| N = Load (in pounds) |
| P = Pressure (in pounds per square inch) |

HYPOTHETICAL SPRINKLER WITH THRUST BEARING $$A = \text{Area} = \frac{(.6875'' \text{ dia.})^2 \pi}{4} = .37122 \text{ S.I.}$$

| Case No. 1 - 15 P.S.I. | Case No. 2 - 40 P.S.I. |
|---|---|
| N = A × P | |
| = 5.56835 lbs. | = 14.84880 lbs. |
| F = .33 (5.56835 lbs.) | = .33 (14.84840 lbs.) |
| = 1.83755 lbs. | = 4.90010 lbs. |

HALF OR QUARTER CIRCLE SPRINKLERS 10,231 WITH RADIAL BEARINGS (180 and 90 degrees arcs)
Circumference of Arc Shield Opening (C) = .950"
Area (A) = C (W) = .03800 S.I.
Width of Face (W) = .040"

| Case No. 1 - 15 P.S.I. | Case No. 2 - 40 P.S.I. |
|---|---|
| N = A × P = .570 lbs. | = 1.52 lbs. |
| F = .33 (.570 lbs.) | = .33 (1.52 lbs.) |
| = .1881 lbs. | = .5016 lbs. |
| % = 10.2* | % = 10.2* |

FULL CIRCLE
SPRINKLER 251 WITH FULL CIRCLE BEARINGS

Contact Surface Area (theoretically) =

$$\frac{\left(\frac{1}{\text{infinity}}\right)^2 \pi}{4} = \frac{1}{\text{infinity}} = 0$$

Actual width = assume .015" wide (approaches zero)
O.D. (of contact zone) = .468" = $D_2$
I.D. (assuming .015" wide contact area) = .438" = $D_2$ $$\frac{\pi(D_1^2 - D_2^2)}{4} = A = \frac{\pi(.468^2 - .438^2)}{4} = .02135 \text{ S.I.}$$

| Case No. 1 - 15 P.S.I. | Case No. 2 - 40 P.S.I. |
|---|---|
| N = A × P | = .8540 lbs. |
| = .3203 lbs. | |
| F = .33 (.3201 lbs.) | F = .33 (.8536 lbs.) |
| = .10568 lbs. | = .28182 lbs. |
| % = 5.8* | % = 5.8* |

*Percentage of anti-rotational frictional drag associated with hypothetical sprinkler with thrust bearing as determined by:

$$\frac{F_1 \text{ (sprinkler 10, 321 and 251)}}{F_2 \text{ (hypothetical sprinkler with thrust bearing)}} \times 100 = \%$$

It is to be understood that while certain forms of the present invention have been illustrated and described herein, it is not to be limited to the specific forms or arrangement of parts described and shown.

What is claimed and desired to be secured by Letters Patent is as follows:

1. A sprinkler, which comprises:

(a) a container including a container bore and a water inlet for admitting water to said container bore;

(b) a motor reciprocably received in said container bore and movable between retracted and extended positions, said motor including:

(1) a stator having an upper end and a stator said stator bore communicating water with said container bore; and (2) a rotor rotatably received within said stator bore, said rotor including upper and lower ends, a vertical rotational axis and a turret having an inlet orifice communicating water with said stator bore and an outlet orifice;

(c) hydraulic drive means adapted for rotating said rotor, and (d) enclosure means positioned above said stator upper end and rotatably and sealingly engaging said rotor, said enclosure means defining an opening adapted to communicate with said turret outlet orifice and defining an enclosed water chamber between said enclosure means and said rotor upper end, said water chamber communicating water with said stator bore but not communicating water directly to said outlet opening.

2. The sprinkler according to claim 1, which includes:

(a) said water chamber comprising an upper water chamber;

(b) said stator having a lower end;

(c) a bottom plate mounted on said stator lower end and defining a lower water chamber receiving said rotor lower end; and (d) a stator water inlet communicating water between said container bore and said lower water chamber.

3. The sprinkler according to claim 2, which includes:

(a) said stator water inlet having a cross-sectional area substantially equal to or greater than the cross-sectional area of said turret inlet orifice.

4. The sprinkler according to claim 3 wherein:

(a) said stator water inlet cross-sectional area is substantially equal to the cross-sectional area of said turret inlet orifice.

5. The sprinkler according to claim 1 wherein said hydraulic drive means comprises:

(a) an impact lever on said rotor;

(b) a ball adapted to strike said impact lever; and (c) vortex means adapted for creating an hydraulic vortex in said stator.

6. The sprinkler according to claim 5, which includes:

(a) said stator having a hollow base with a raceway for said ball;

(b) a plate assembly mounted on said stator below said hollow base and enclosing said raceway;

(c) said impact lever extending into said raceway; and (d) said vortex means comprising a water passage extending through said plate assembly.

7. The sprinkler according to claim 6, wherein said vortex means includes:

(a) a plurality of swirl jets positioned in said plate assembly, each said swirl jet including a respective water passage extending in a direction tangential to said rotational axis of said rotor.

8. The sprinkler according to claim 1, which includes:

(a) said stator having a stator base with a coaxial, annular stabilizer ring shoulder open to said stator bore;

(b) a stabilizer ring received in said stabilizer ring shoulder and rotatably receiving said rotor; and (c) a bumper washer mounted on said rotor adjacent to said rotor lower end, said bumper washer being adapted to engage said stabilizer ring to limit the upward travel of said rotor within said stator.

9. The sprinkler according to claim 8 wherein:

(a) said stabilizer ring shoulder includes a plurality of radially-spaced notches extending between and communicating water between said stator base and said stator bore.

10. The sprinkler according to claim 1 wherein:

(a) said enclosure means comprises an arc shield and said enclosure means opening comprises an arc shield slot selectively aligned with said turret outlet orifice.

11. The sprinkler according to claim 10 wherein:

(a) said arc shield slot extends approximately 90° around said arc shield.

12. The sprinkler according to claim 10 wherein:

(a) said arc shield slot extends approximately 180° around said arc shield.

13. The sprinkler according to claim 10 wherein:

(a) said arc shield slot extends approximately 360° around said arc shield.

14. The sprinkler according to claim 10 wherein said arc shield includes:

(a) an arc shield bore; and (b) a turret bearing extending inwardly from said arc shield bore around said arc shield slot and slidably engaging said turret.

15. The sprinkler according to claim 10, which includes:

(a) said turret having upper and lower ends;

(b) a flexible upper washer connected to said arc shield and engaging said turret upper end; and (c) a flexible lower washer connected to said stator and engaging said turret lower end.

16. The sprinkler according to claim 1, which includes:

(a) speed regulator means adapted to control the rotational speed of said motor and to compensate for changes in hydraulic pressure.

17. The sprinkler according to claim 16 wherein said speed regulator means includes:

(a) a plate assembly mounted on said stator;

(b) a coaxial valve spool mounted on said plate assembly and including a downwardly-tapering lower end portion;

(c) an elastomeric diaphragm mounted on said plate assembly and having a diaphragm opening receiving said valve spool lower end portion;

(d) an anti-swirl jet extending through said plate assembly and adapted to admit water into said motor for opposing the rotation of said motor; and (e) said diaphragm opening admitting water from said plate assembly to said anti-swirl jet.

18. The sprinkler according to claim 1, which includes:

(a) said stator bore having upper and lower ends;

(b) a stator base receiving water from said container bore;

(c) a stabilizer ring associated with said stator bore lower end and rotatably receiving said rotor;

(d) a stator water inlet associated with said stabilizer ring and adapted to communicate water between said stator base and said stator bore;

(e) said rotor including a rotor base; and (f) bumper means associated with said rotor base and being adapted to engage said stabilizer ring.

19. The sprinkler according to claim 18, which includes:

(a) said stator water inlet being positioned outside of said stabilizer ring and comprising an outer stator water inlet; and (b) an inner stator bore water inlet positioned between said stabilizer ring and said rotor.

20. The sprinkler according to claim 1 wherein:

(a) as said rotor rotates respective orifices alternately function as said inlet orifice in communication with said water chamber and as said outlet orifice in communication with said enclosure means opening.

* * * * *